United States Patent [19]

Lorenzana et al.

[11] Patent Number: 4,835,813

[45] Date of Patent: Jun. 6, 1989

[54] PROTECTIVE COVER FOR TOOTHBRUSH

[76] Inventors: Moises B. Lorenzana, 601 Lake Hinsdale Dr., Willowbrook, Ill. 60559; Vance A. Lorenzana, 698 Spring Hill Cir., Naperville, Ill. 60540

[21] Appl. No.: 170,006

[22] Filed: Mar. 18, 1988

[51] Int. Cl.[4] ..... A46B 17/04

[52] U.S. Cl. ..... 15/184; 206/362.3

[58] Field of Search ..... 15/184; 206/15.2, 15.3, 206/361, 362, 362.1, 362.2, 362.3; 132/84 R, 84 A, 84 B, 84 C, 84 D; 401/124, 262, 269; D4/108, 121, 199, 113

[56] References Cited

U.S. PATENT DOCUMENTS

| | | | |
|---|---|---|---|
| D. 170,095 | 7/1953 | Schotland | D4/108 |
| D. 220,465 | 4/1971 | Fohrman | D4/113 |
| 741,321 | 10/1903 | Flower | 206/362.3 |
| 1,041,315 | 10/1912 | Marx | 206/362.3 |
| 1,115,061 | 10/1914 | Foster | 206/362.3 |
| 1,213,235 | 1/1917 | Meiers | 206/362.3 |
| 1,444,368 | 2/1923 | Conley | 206/362.3 |
| 1,588,781 | 6/1926 | Stoddard | 206/362.3 |
| 1,653,540 | 12/1927 | Bigoney | 206/362.3 |
| 1,710,725 | 4/1929 | Duskin et al. | 206/362.3 |
| 1,716,842 | 6/1929 | Salak | 206/362.3 |
| 2,655,968 | 10/1953 | Simmons | 15/184 X |
| 2,667,395 | 1/1954 | Ushanoff | 206/362.1 X |
| 3,120,019 | 2/1964 | Scott | 15/184 |
| 3,127,985 | 4/1964 | Scott | 206/362.3 |
| 3,331,493 | 7/1967 | Anglin | 206/361 |
| 3,574,879 | 4/1971 | Werding | 206/362.2 X |

FOREIGN PATENT DOCUMENTS

| | | | |
|---|---|---|---|
| 734794 | 5/1966 | Canada | 206/361 |
| 1110599 | 2/1956 | France | 206/361 |
| 734246 | 7/1956 | United Kingdom | 206/361 |

*Primary Examiner*—Harvey C. Hornsby
*Assistant Examiner*—Scott J. Haugland
*Attorney, Agent, or Firm*—Neil M. Rose

[57] ABSTRACT

A one piece plastic molded protective cover for a toothbrush having an elongated cavity formed by converging sidewalls interconnected along spaced parallel edges and having laterally displaced openings at opposite ends to permit storage of a toothbrush head within the cavity and air circulation therethrough.

7 Claims, 1 Drawing Sheet

PROTECTIVE COVER FOR TOOTHBRUSH

BACKGROUND OF THE INVENTION

This invention relates generally to protective covers for toothbrushes and more specifically to a one piece cover which encloses the bristled end or head of a toothbrush for protecting the head during travel or storage of the toothbrush.

In order to keep the head of a toothbrush sanitary and uncontaminated by foreign matter which may be in the area in which the toothbrush is stored, it has been well known to provide various types of cases and covers for toothbrushes. Some of these cases or covers are adapted for use in the bathroom where the toothbrush is normally used and, in such applications, such cases or covers may be designed for wall mounting. Other such cases or covers are intended primarily for use when traveling, being compact and being suitable for use when storing the toothbrush in a small container or kit for toilet articles.

Some of the prior art cases are designed to enclose the entire toothbrush while others are intended to enclose only the bristled end or the head of the toothbrush. Examples of such prior art toothbrush covers are shown in the following U.S. Pat. Nos.: Werding 3,574,879, Scott 3,127,985, Scott 3,120,019, Sulak 1,716,842, Bigoney 1,653,540, Meiers 1,213,235, Stoddard 1,588,781, Foster 1,115,061, Conley 1,444,368, Marx 1,041,315 and Flower 741,321. Some of the foregoing patents relate to covers or cases which have hingeably related parts which open to receive the head of the toothbrush and then close to form an enclosure within which the head is received. Others, as for example Werding, Sulak, Bigoney and Stoddard simply have an opening through which the head is inserted into its storage position. Some of the prior art covers or cases have provided openings to permit air to circulate through the enclosure for the brush head so that the bristles will tend to dry between brushings thereby retaining their stiffness and effectiveness.

BRIEF SUMMARY OF THE INVENTION

Our invention is directed to a simple, one piece cover for a toothbrush. It is of a shape and design which is inexpensive to mold of plastic material and provides an enclosure for the head of a toothbrush with means to maintain the shape of the bristles and air circulation openings which expediate drying of the bristles. The cover is elongated with openings at opposite ends being displaced laterally from each other. The cover is formed with converging sidewalls which support parallel spaced ribs which engage the brush bristles to support the brush bristles in spaced relation to the bottom of the cover to facilitate drying of the bristles.

Accordingly, it is an object of the present invention to provide a compact, one piece toothbrush cover which may be molded inexpensively of plastic material.

It is another object of the present invention to provide an improved one piece plastic toothbrush cover which has a configuration permitting air circulation for drying the bristles of a toothbrush stored therein.

It is a further object of the present invention to provide an improved toothbrush cover which is easy and inexpensive to mold and includes an interior configuration to improve drying of the bristles.

While the present invention is described with particularity in the claims annexed to and forming a part of this specification, a better understanding of the invention can be had by reference to the following description taken in conjunction with the accompanyng drawings in which:

Figure 2:
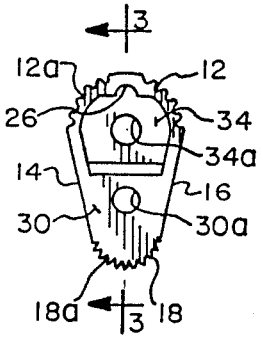
FIG. 2 is a front end elevational view of the cover of FIG. 1.
Figure 4:
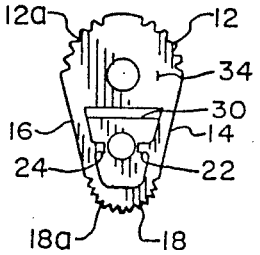
FIG. 4 is a rear end elevational view of the cover of FIG. 1.
Figure 6:
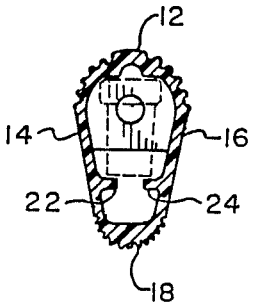
FIG. 6 is a sectional view taken on line 6—6 of FIG. 5.

Referring to the drawings, there is shown a toothbrush protective cover embodying our invention and designated generally by reference numeral 11. The cover 11 is elongated having a uniform exterior shape and configuration throughout its length. The cover 11 includes a cylindrical portion 12 which is actually semi-cylindrical in shape as shown in FIGS. 2, 4 and 6 as forming the upper portion of the cover 11. Extending downwardly from the cylindrical portion 12 are converging side walls 14 and 16 which are interconnected at their lower edges by a rounded connecting portion 18. The portion 18 is semi-cylindrical in shape having a radius equal to about 5/9's of the radius of the cylindrical portion 12. The two semi-cylindrical portions 12 and 18 connected by the converging walls 14 and 16 provide a shape as viewed from the end in FIGS. 2, 4 or in section as in FIG. 6 which may be considered generally teardrop in shape.

Within the cover 11, there is an elongated cavity 20 which is unobstructed except for a pair of lengthwise extending ribs 22 and 24. As will be explained more fully below, the ribs 22 and 24 are parallel and spaced apart a distance less than the width of the bristled portion of a toothbrush.

Figure 1:
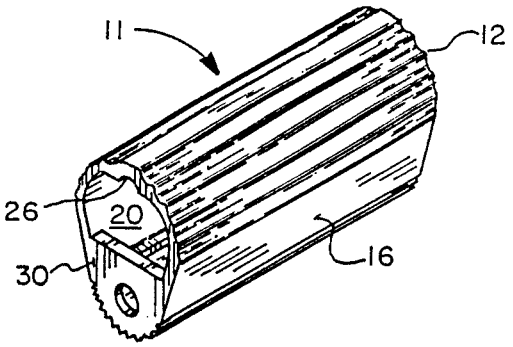
FIG. 1 is a front right side perspective view from above of a protective cover for a toothbrush embodying our invention.
Figure 3:
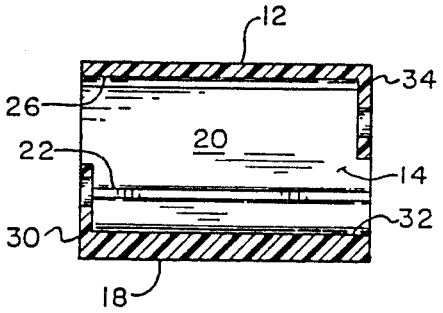
FIG. 3 is a sectional view taken on line 3—3 of FIG. 2.
Figure 5:
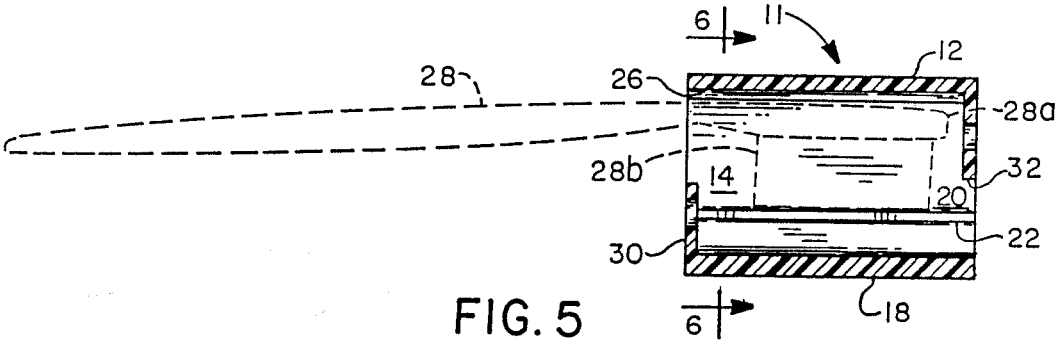
FIG. 5 is a sectional view corresponding to FIG. 3 but showng a toothbrush in dashed lines in the position it would occupy when the cover of FIG. 1 is positioned over the head portion of the toothbrush.

The cover 11 is formed with a first opening 26 at the front end as shown in FIG. 1. It is through the opening 26 that a portion of a toothbrush 28 may be inserted into the cavity 20. The opening 26 is of such size that a head portion 28*a* of toothbrush 28 with bristles 28*b* may be inserted as shown in FIGS. 5 and 6. The bristles 28*b* of a conventional size toothbrush would have to be flexed from the normal upright position to permit the head portion to enter the cavity 20. Partially defining the opening 26 is an end wall 30 which is generally perpendicular to the axis of the cylindrical portion 18 and extends between the converging walls 14 and 16 as shown in FIGS. 1, 2 and 3.

At the rear end of the cover 11, the end opposite from the one which supports the wall 30, there is a second opening 32 which is spaced lengthwise in cover 11 opposite the wall 30. Adjacent the opening 32 is a rear end wall 34 which is spaced lengthwise from and opposite the opening 26. As may be seen from FIGS. 2, 3 and 4, the lengthwise projections of the walls 30 and 34 do not come together leaving a lengthwise extending slot which is unobstructed.

The opening 32 cooperates with the opening 26 to permit air to circulate through the cover 11 so as to dry the bristles 28*b* between uses. It is well understood that bristles that are dry initially when used are more stiff and more effective in removing material from the crevaces between the teeth.

The ribs 22 and 24 perform two functions. First, as explained above, they engage lower ends of the bristles along the edge of the bristled portion 28*b* of the toothbrush head and maintain the bristles well spaced above the bottom of the cavity 20. By maintaining the bristled portion well spaced from the lower part of cavity 20, water is not trapped against the bristles and air may circulate readily to dry the bristles between uses of the toothbrush. The second function is to provide a partial obstruction in the opening 32 so that the brush head 28*a* may not inadvertently be pushed completely through the cover 11 and out through the opening 32.

The above described design and configuration of the cover 11 is simple and easy to mold in the presently known high production plastic molding machines. As would be evident to one skilled in the art of plastic molding, the parting line for the cooperating parts of the mold would be made coincident with the walls 30 and 34 thereby eliminating the need for any side cores of the like. The cores in the mold to form the cavity 20 would extend lengthwise through the openings 26 and 32 and terminate at the inside faces of walls 30 and 34 with the cores abutting along a plane extending from the top of wall 30 to the bottom of wall 34. the end walls 30 and 34 are formed with circular openings 30*a* and 34*a* respectively which holes are formed by locating pins which would extend from one mold half into openings in the other mold half in a manner known in the art.

In order to reduce the weight and material required while retaining strength and rigidity, the cylindrical portions 12 and 18 are formed with lengthwise extending serrations 12*a* and 18*a* respectivey.

The cavity 20 is made sufficiently long to accommodate any commercially available toothbrushes some of which have elongated bristled portions or heads 28b. The geometry of the cover 11 is also suitable for accommodating the small toothbrushes sold for use by children.

What is claimed as new and desired to be secured by Letters Patent of the United States is:

1. A protective cover for a toothbrush of the type having a handle connected to a head portion with bristles extending from one side thereof comprising a housing forming an elongated chamber which is of a size to enclose the head portion of said toothbrush, said housing having an elongated generally cylindrical portion, said cylindrical portion having a first end which is open to provide a first opening and having a second end which is closed by a first transverse wall which extends normal to the axis of said cylindrical portion, a pair of converging walls which are generally tangential to said cylindrical portion and form a bristle enclosing portion of said housing which is in open communication with said cylindrical portion, said bristle enclosing portion having a second transverse wall which is parallel to said first transverse wall and adjacent the first end of said cylindrical portion, said bristle enclosing portion of said housing having one end which is adjacent said first transverse wall and open to provide a second opening in said elongated chamber, a pair of parallel spaced inwardly directed ribs on opposed faces of said converging walls to support the bristles of said toothbrush, said first opening in said first end of said cylindrical portion being of a size to receive said head portion of said toothbrush and said second opening in said bristle enclosing portion being sufficiently small to prevent said head portion of said toothbrush from passing therethrough, said bristle enclosing portion of said housing having an elongated cylindrical edge which interconnects said converging walls, said cylindrical edge having an axis which is parallel to and spaced from the axis of said cylindrical portion of said housing, said spaced inwardly directed ribs supporting said bristles in spaced relationship to said cylindrical edge and retaining the head portion and bristles on one side of the ribs to increase the exposure of the bristles to air for drying said bristles after brushing.

2. The protective cover of claim 1 wherein said cylindrical portion and said cylindrical edge are formed with lengthwise extending serrations.

3. The protective cover of claim 1 wherein said first and second transverse walls are displaced laterally from each other whereby said housing may be molded with the parting lines at said transverse walls with no side cores required in the mold.

4. The protective cover of claim 1 wherein said first and second openings are displaced to provide an air path through said housing across said toothbrush bristles to permit the drying of a toothbrush stored within said protective cover.

5. A protective cover for a toothbrush of the type having a handle and a head which includes bristles extending from a back portion comprising a housing of a size to snugly enclose said head of said toothbrush including the bristles and the back portion, said housing being elongated and having a first end with a first opening and a second end with a second opening, said housing having a shape in section transverse to its length which is generally teardrop in shape formed by converging sidewalls connected by first and second cylindrical sections, the radius of said first cylindrical section being substantially larger than the radius of said second cylindrical section, said first opening being of a size to receive said head of a toothbrush, a first transverse wall adjacent said first opening, said second opening being opposite to and corresponding in size to said first transverse wall, a second transverse wall adjacent to said second opening and being opposite to and corresponding in size to said first opening, said second opening being of a size such that said head may not pass therethrough, said converging sidewalls being formed with a pair of spaced parallel ribs which extend lengthwise of said cover and extend from said second opening to said first transverse wall, said ribs being positioned to engage the bristles along the outer edges of the toothbrush head to support said toothbrush head with the bristles retained on one side of said ribs and spaced from said second cylindrical section and exposed to air which may enter said cover through said openings to dry said bristles after use.

6. The protective cover of claim 5, wherein said first and second walls are each formed to define a circular hole whicn is aligned with said first or second opening.

7. The protective cover of claim 5 wherein said first and second generally cylindrical sections are formed with lengthwise extending serrations on their outer surfaces.

* * * * *